US005101516A

United States Patent [19]

Scarnato

[11] Patent Number: 5,101,516

[45] Date of Patent: Apr. 7, 1992

[54] SYSTEM FOR VENTILATING BROW BAND AREA OF A CAP/SUN VISOR

[76] Inventor: Thomas J. Scarnato, 381 N. Valley Rd., Barrington, Ill. 60010

[21] Appl. No.: 635,263

[22] Filed: Dec. 28, 1990

[51] Int. Cl.[5] ..... A42C 5/00

[52] U.S. Cl. ..... 2/181.2; 2/181; 2/181.4; 2/182.6; 2/DIG. 11

[58] Field of Search ..... 2/171, 181, 181.2, 181.4, 2/182.1, 182.2, 182.4, 182.6, 182.8, 184.5, 195, 199, 209.3, 209.4, 209.5, 209.7, DIG. 11

[56] References Cited

U.S. PATENT DOCUMENTS

| | | | |
|---|---|---|---|
| 660,062 | 10/1900 | Mahoney | 2/181.2 |
| 923,986 | 6/1909 | Morigl | 2/181.4 |
| 1,209,093 | 12/1916 | Whitlow | 2/181.2 |
| 1,434,743 | 11/1922 | Hardman | 2/181.2 |
| 1,566,891 | 12/1925 | Lyon | 2/181 |
| 1,725,520 | 8/1929 | Kaplan | 2/209.5 |
| 2,129,798 | 9/1938 | Trumbull | 2/181.4 |
| 2,445,209 | 7/1948 | Clark | 2/181 |
| 2,818,574 | 1/1958 | Burnison | 2/181.2 |
| 3,289,212 | 12/1966 | Morgan | 2/181.4 |
| 3,780,382 | 12/1973 | Boden | 2/182.6 |
| 4,101,981 | 7/1978 | Boden | 2/182.6 |
| 4,434,514 | 3/1984 | Sundahl | 2/425 |
| 4,691,389 | 9/1987 | Meyer | 2/195 |
| 4,918,758 | 4/1990 | Rendina | 2/171 |
| 4,951,320 | 8/1990 | Yoon | 2/DIG. 11 |

*Primary Examiner*—Werner H. Schroeder
*Assistant Examiner*—Diana L. Biefeld
*Attorney, Agent, or Firm*—Kajane McManus

[57] ABSTRACT

The ventilating system is proposed for use with a head cover including a visor like structure engaged to the forehead of a wearer by a sweat band and includes spaced apart resilient, porous, absorbent members removably engaged to an area of the sweat band which would normally engage the forehead of the wearer to space that area of the sweat band away from the forehead. The spaces between the resilient, porous, absorbent members create paths therebetween through which air can pass across the forehead of the wearer. Still further, evaporation of any perspiration collected in the absorbent members will provide a cooling effect to the forehead of the wearer.

20 Claims, 2 Drawing Sheets

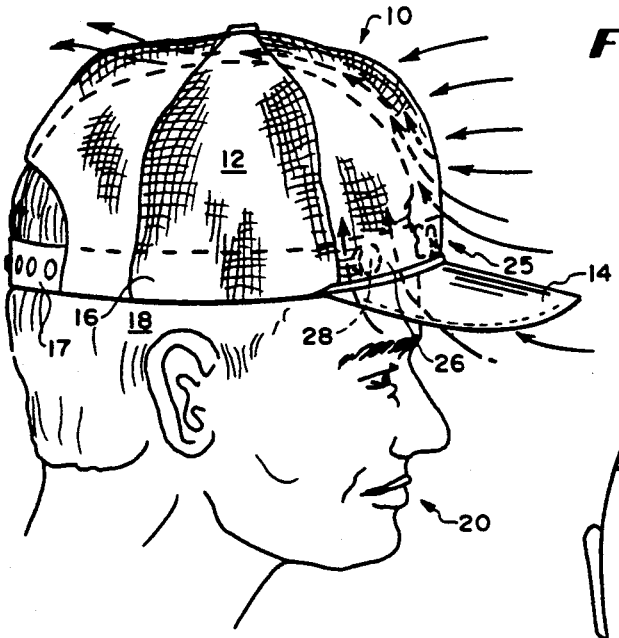
FIG. 1
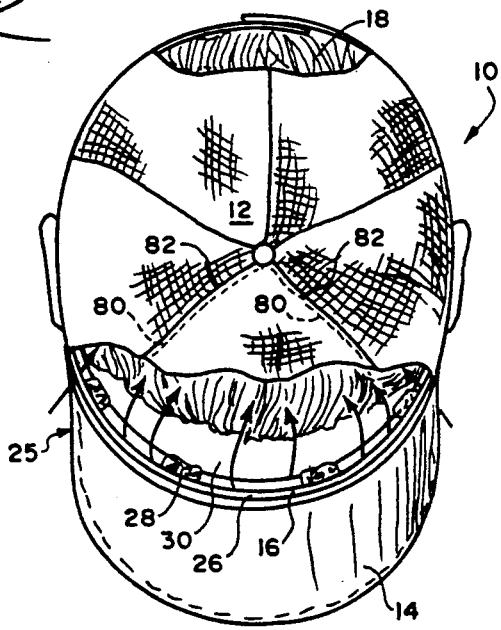
FIG. 2
FIG. 3
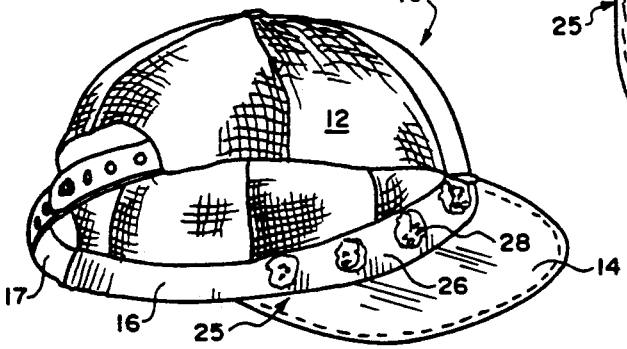
FIG. 4
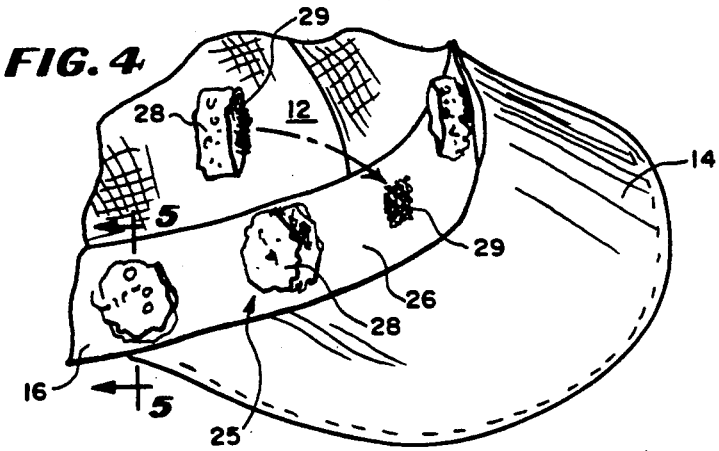
FIG. 5
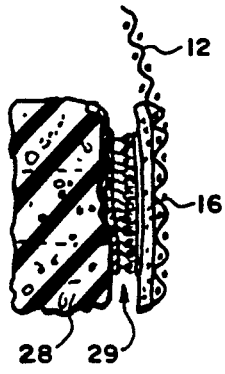

SYSTEM FOR VENTILATING BROW BAND AREA OF A CAP/SUN VISOR

BACKGROUND OF THE INVENTION

The present invention relates to a system for ventilating and cooling the forehead contacting area of a sweat or brow band of a cap or sun visor worn during hot summer months.

More particularly, the system comprises a set of spacer elements engageable to the interior surface of the sweat or brow band for creating air spaces between the forehead of a wearer of the band, the spacer elements being made of a material which is porous and absorbent to capture any perspiration, which might still develop, therein, and, by evaporation of the perspiration therefrom, produce a cooling effect against the forehead.

PRIOR ART

The creation of perspiration along a brow band of a visor or cap during hot summer months has been a long standing problem relating to the use of such items.

To date, no simple solution has been provided, although elaborate means of controlling perspiration on the forehead of a wearer have been proposed.

For example, there exists a solar powered, ventilated golf cap which includes an opening along a forehead engaging area thereof into which a constant breeze is blown by a solar powered fan mounted on the visor portion of the cap.

Further, other complex solutions may be found in U.S. Pat. Nos. 30.643, 562,817, 663,311, 917,873, 941,717, 987,501, 2,218,590, 3,925,821 and 4,434,514.

Still further, some less extravagant solutions directed specifically to sports or athletic caps, are proposed in the Boden U.S. Pat. No. 4,101,981 and the Fender U.S. Pat. No. 4,550,445.

The Boden U.S. Pat. No. 4,101,981 discloses a cap or hat made of non-ventilating material which includes ventilation openings including a top opening beneath which a baffle is movably supported, and with the band of the hat or cap having two essentially rigid, horizontally spaced, pivotably mounted spacer elements which engage the user's head at different locations to hold the band away from at least the front and side portions of the user's head and with the band containing one or more stiffening members for maintaining the shape of the band while thus spaced from the head.

The Fender U.S. Pat. No. 4,550,454 discloses a ventilated athletic cap comprising an adjustable headband, a semi-rigid visor, and a canopy attached to the outer edges of the visor. The canopy is made of formed cloth or semi-rigid material to maintain its shape and a spaced relationship with the head of the wearer. The canopy further contains air vents at the front and rear to permit unrestricted flow of air about the head of the wearer.

As will be described in greater detail hereinafter, the system of the present invention includes a plurality of simple porous, absorbent spacer elements, which can be engaged in a spaced apart manner across the interior surface of the forehead engaging portion of the sweat or brow band of a cap or sun visor.

SUMMARY OF THE INVENTION

According to the invention there is provided a system for eliminating the formation of perspiration along a sweat band portion of a cap or sun visor which seats against the forehead of the wearer. The system includes a plurality of spaced apart porous, absorbent spacer elements which are secured to the interior surface of the sweat band to space the sweat band away from the forehead of the wearer and to absorb any slight degree of perspiration from the forehead which may develop, the absorbed perspiration being eliminated by evaporation which further serves to cool the forehead of the wearer.

BRIEF DESCRIPTION OF THE DRAWINGS

FIG. 1 shows a side view of a mesh crown summer cap including a first embodiment of the ventilating system of the present invention seated on the head of a wearer.

FIG. 2 is a top plan view of the cap with portions broken away to show the ventilating system between the sweat band of the cap and the forehead of the wearer.

FIG. 3 is a bottom perspective view of the cap showing the ventilating system engaged to the sweat band of the cap.

FIG. 4 is an enlarged view of the portion of the sweat band incorporating the ventilating system.

FIG. 5 is a cross sectional view through a spacer element of the system showing one attachment mode, and is taken along line 5—5 of FIG. 4.

DESCRIPTION OF THE PREFERRED EMBODIMENTS

Figure 6:
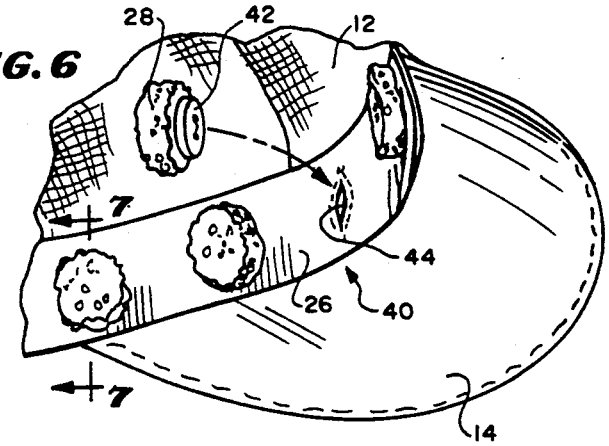
FIG. 6 is an enlarged view of the portion of the sweat band incorporating the ventilating system and shows a further mode of attaching the spacer elements of the system to the sweat band.

Referring now to the drawings in greater detail there is illustrated in FIGS. 1—7 a commonly available cap 10 which includes a mesh crown 12, a visor 14, a sweat band 16 and strap members 17 which are adjustable to secure the cap 10 to the head 18 of a wearer 20.

Air flow through the mesh crown 12 is shown by solid arrows.

This cap 10, which is readily available for purchase, has been improved by including a ventilating system 25 made in accordance with the teachings of the present invention along a portion 26 of the sweat band 16 adjacent the cap visor 14.

As better illustrated in FIGS. 2 and 3 the ventilating system 25 includes a plurality of spaced apart spacer elements 28 which space the portion 26 of the sweat band 16 from the forehead 30 of the wearer 20. These spacer elements 28 create pathways therebetween through which air can flow upwardly from under the visor 14 across the forehead 30 of the wearer as shown by the dashed arrows in FIG. 1.

The spacer elements 28 also serve a further purpose. In this respect, it is proposed to form the spacer elements 28 of a porous, absorbent material, such as sponge material, to provide for absorption of any minor amount of perspiration which may develop. Because of the porous nature of the sponge material, a continuous evaporation process is initiated of the perspiration absorbed by the spacer elements 28 because of the flow of air around the spacer elements 28 and creates a cooling effect against the forehead 30 of the wearer 20.

Inasmuch as these sponge spacer elements 28 may eventually require replacement to adequately maintain resiliency, porosity and absorbency, it is proposed to make them easily replaceable.

One method of accomplishing this is to engage the elements 28 to the sweat band 16 by means of Velcro® fasteners 29, as best shown in FIGS. 4 and 5.

Figure 7:
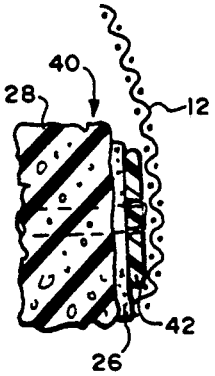
FIG. 7 is a cross sectional view through one of the spacer elements of FIG. 6 and is taken along line 7—7 of FIG. 6.

Further, the elements 28 may be engaged by a button/buttonhole arrangement 40, as shown in FIGS. 6 and 7.

In this respect, it is preferable that each element 28 be provided with the button 42 which may engage within a buttonhole 44 for same within the sweat band 16. Thus, if the cap 10 were ever worn without the elements 28 attached, no irritation of the forehead 30 of the wearer 20 would be produced by an uncovered remaining button 42 engaged to the sweat band portion 26.

Figure 10:
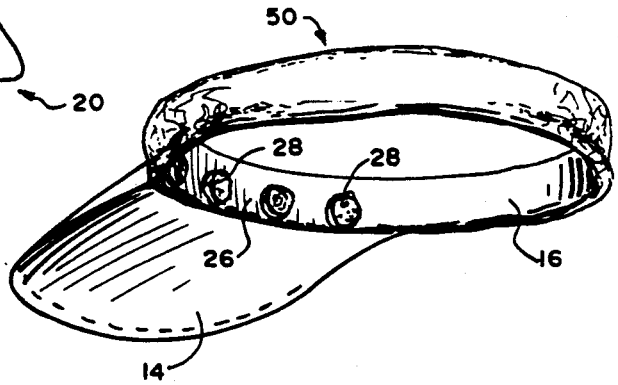
FIG. 10 is a perspective view of a sun visor incorporating the ventilating system of the present invention.

Turning for a moment to FIG. 10, it will also be understood that the ventilating system 25 of the present invention would be ideally suited for use on a simple sun visor 50 as well.

Figure 8:
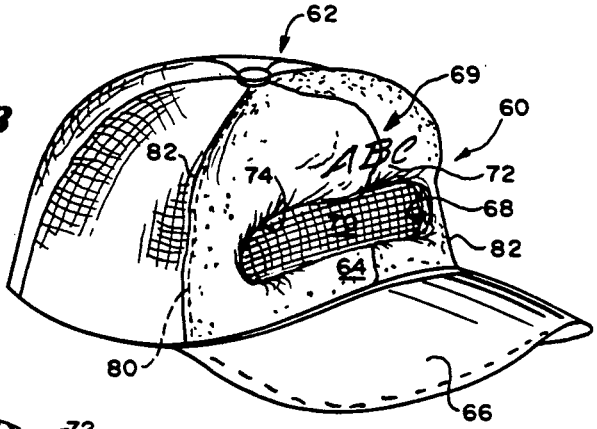
FIG. 8 is a perspective view of a cap having a solid material front panel engaged to a mesh material forming the remainder of the cap crown with which a second embodiment of the ventilating system is utilized.
Figure 9:
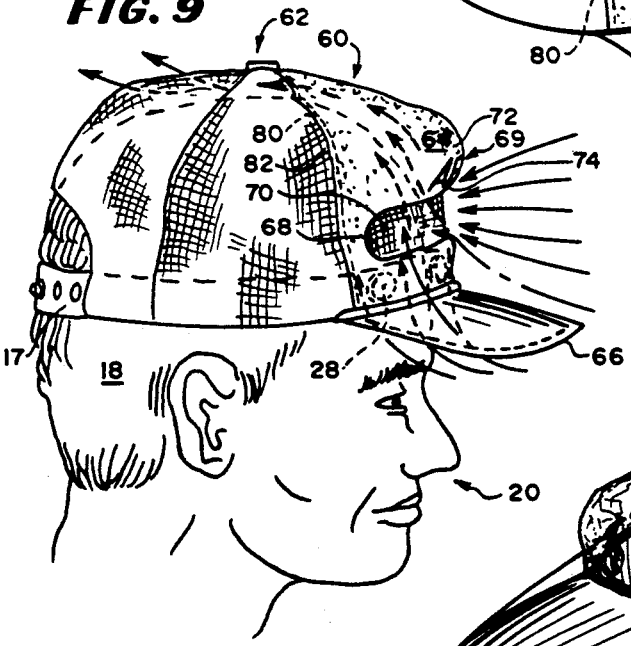
FIG. 9 is a side view of the cap of FIG. 8 shown on the head of a wearer.

Backtracking to FIGS. 8 and 9, there is illustrated therein another commonly available cap 60, the crown 62 of which includes a front panel 64 made of a non-mesh, polyester-type material which extends from along the cap visor 66 taperingly upwardly to an approximately center point of the crown 62.

This front panel 64 significantly reduces air flow therethrough, creating a warming effect upon the forehead 30 of the wearer 20.

In this cap 60, use of the ventilating system 25 is seen to significantly decrease the warming effect created by the non-mesh front panel 64.

To further increase air circulation across the forehead 30, if desired, a horizontal cutout 68 may be created within the front panel 64, immediately above the level of the sweat band 16, for increasing circulation of air through the crown 62 of the cap 60. The cutout 68, as shown, is sized and configured in such a manner as not to interfere with the placement of a logo 69 or the like on the front panel 64, as shown.

The cutout 68 may include a section of mesh 70 sewn into and extending across the extent thereof. This mesh section 70 maintains continuity of the crown 62, as well as covering the opening within the cutout 68 to keep flies, bees or the like from entering the area between the crown 62 and the top of the wearer's head 18.

Further, it will be seen that a portion 72 of the front panel 64 collapses over an upper edge 74 of the cutout 68, due to the decreased stiffness of the panel 64 in the area of the cutout 68.

This collapsed portion 72 has been found through empirical testing to create a funneling effect on air impinging on the area of the front panel between the visor 66 and the collapsed portion 72 and directs same into the cutout 68, at an increased velocity relative to that of the ambient air, cooling the forehead 30 of the wearer 20 and also increasing the cooling effect produced by the ventilating system 25 by creating an upwardly directed vacuum along the top of the sweat band 16 which draws air in an accelerated stream from under the visor 66 into and through the pathways between the spacer elements 28.

Also, although not required for effectiveness of the ventilating system 25, it is proposed to provide shape retaining stays 80 or the like along crown seams 82 extending upwardly from the visor 14, 66 to the center point of the crown 12, 62 of the cap 60, as shown in phantom in the FIGS., to keep the crown 12, 62 from becoming depressed against the head 18 of the wearer 20.

As described above, the ventilating system 25 of the present invention has a number of advantages, some of which have been described above and others of which are inherent in the invention. For example, the staining of the cap 10, 60 by perspiration in the area along the forehead is virtually eliminated, increasing the life of the cap 10, 60 as it relates to the aesthetic appearance thereof. Also, the system 25 is extremely cost effective and does anything but detract from the appearance of the cap 10, 60. Further, a single ventilating system 25, when provided with a button/buttonhole arrangement 40, may be used interchangeably with numerous readily available caps, providing cost effectiveness. Further, the ventilating system 25 may be used with any caps 10, 60 that a user may already own, by simply forming buttonholes 44 in the sweat band thereof and engaging the spacer elements 28 thereto.

Also modifications may be proposed to the system 10, without departing from the teachings of the present invention. Accordingly the scope of the invention is only to be limited as necessitated by the accompanying claims.

I claim:

1. A ventilating system for creating air paths between a sweat band provided for engagement of a head cover including a visor like structure and the forehead of a wearer thereof, said system consisting of a plurality of individual spaced apart, resilient, porous and absorbent means which are not joined to each other by any means and which are removably attached to the sweat band for spacing the sweat band from the forehead.

2. The system of claim 1 wherein said spaced apart means for spacing the sweat band from the forehead comprise individual small rounded sections of material.

3. The system of claim 2 wherein said material is a sponge material.

4. The system of claim 3 wherein said spaced apart means are engaged to the sweat band by Velcro® fasteners.

5. The system of claim 4 wherein said visor including structure comprises a cap.

6. The system of claim 5 wherein said visor including structure comprises a sun visor.

7. The system of claim 3 wherein said spaced apart means are engaged to said sweat band by a button/buttonhole arrangement.

8. The system of claim 7 wherein a button of the button/buttonhole arrangement is engaged to said spaced apart means.

9. The system of claim 8 wherein a button hole of said button/buttonhole arrangement is created in the sweat band.

10. The system of claim 9 wherein said visor including structure comprises a sun visor.

11. The system of claim 10 wherein said visor including structure comprises a cap.

12. The system of claim 11 wherein said cap includes a crown made of mesh.

13. The system of claim 12 wherein said cap includes shape retaining stays along seams of said front panel to maintain said cap crown elevated with respect to the top of the head of the wearer.

14. The system of claim 11 wherein said cap includes a front panel made of polyester like material with the remainder of the crown made of mesh.

15. The system of claim 14 wherein said polyester panel includes a horizontal cutout area therein at a level just above the sweat band of the cap.

16. The system of claim 15 wherein said front panel funnels inward toward said horizontal cutout area.

17. The system of claim 16 wherein said cutout includes a panel of mesh material therein.

18. The system of claim 17 wherein said cap includes shape retaining stays along seams of said front panel to maintain said cap crown elevated with respect to the top of the head of the wearer.

19. A ventilating system for use on a cap consisting essentially of a plurality of individual spaced apart resilient, porous, absorbent members which are not joined to each other by any means and which are releasably engaged along an interior surface of a sweat band of said cap in an area engaging the forehead of a wearer of said cap.

20. A ventilating system for use on a sun visor consisting essentially of a plurality of individual spaced apart resilient, porous, absorbent members which are not joined to each other by any means and which are releasably engaged along an interior surface of a sweat band of said sun visor in an area engaging the forehead of a wearer of said sun visor.

* * * * *